United States Patent [19]

Karr, Jr.

[11] Patent Number: 4,612,983

[45] Date of Patent: Sep. 23, 1986

[54] SHEAR TYPE GATE VALVE

[75] Inventor: Michael A. Karr, Jr., Houston, Tex.

[73] Assignee: Gray Tool Company, Houston, Tex.

[21] Appl. No.: 787,344

[22] Filed: Oct. 15, 1985

[51] Int. Cl.[4] ..... E21B 29/04

[52] U.S. Cl. ..... 166/55; 251/1.3

[58] Field of Search ..... 166/55, 55.1, 55.2, 166/297, 361; 251/1.3

[56] References Cited

U.S. PATENT DOCUMENTS

| | | | |
|---|---|---|---|
| 3,561,526 | 2/1971 | Williams, Jr. et al. | 251/1.3 |
| 4,215,749 | 8/1980 | Dare et al. | 166/55 X |
| 4,313,496 | 2/1982 | Childs et al. | 166/55 |
| 4,508,313 | 4/1985 | Jones | 251/1.3 |
| 4,519,575 | 5/1985 | Akkerman et al. | 251/1.3 X |
| 4,531,585 | 7/1985 | Hansen | 166/55 X |

*Primary Examiner*—James A. Leppink
*Assistant Examiner*—Thuy M. Bui
*Attorney, Agent, or Firm*—Edward L. Kochey, Jr.

[57] ABSTRACT

A gate valve for cutting a wire line (20) and closing in a well has a gate assembly (24) formed of an upper gate (32) and a lower gate (34). The lower gate (34) closes first shearing the wire line. Upper gate (32) closes second and seals against upper valve seat (42).

6 Claims, 2 Drawing Figures

SHEAR TYPE GATE VALVE

BACKGROUND OF THE INVENTION

The invention relates to gate valves and in particular to a valve for use on oil wells which will cut a wire line and seal in the well under emergency conditions.

During workover or testing of oil and gas wells, wire line operations are common. A cable passes through the wellhead for supporting and manipulating various tools and instruments.

If an emergency arises requiring the immediate shutin of the well, there is insufficient time to withdraw the cable. It is known to shear the cable so that the well may be closed in.

U.S. Pat. No. 4,215,749 issued Aug. 5, 1980 shows such a valve arranged to always shear the cable with a special shear surface near the upper edge of the gate. Since pressure exits below the valve, the upper side of the gate is the pressure sealing surface. Such shearing action leads to potential damage to the sealing surface during the shearing action. This valve gate has a tapered undercut. Should the cable be unloaded when sheared, the valve depends on gravity plus the tapered undercut to avoid jamming on the sheared end of cable. Since the tapered bottom edge is not well adapted to shearing, it presents a potential for jamming.

It is also known to use a single gate which simultaneously shears the cable at both the top and bottom surfaces of the gate. Again the upper surface is always used for shearing, leading to possible damage of the sealing surface. Substantial force is required because of the double shear.

SUMMARY OF THE INVENTION

A gate valve for use on a wellhead during wire line operation has a valve body with a vertical flow passage therethrough and a gate assembly slidably mounted in the valve body for horizontal movement between an open and closed position. The gate assembly is formed on an upper and lower gate, with these gates being connected to an actuator with a lost motion connection on one of said gates. The flow ports of each gate is aligned when the gate assembly is open, with the lost motion connection arranged to start the lower gate closing prior to movement of the upper gate. Accordingly, the wire line cable is sheared by the lower gate first. If the cable is under tension it will then spring loose, and if it is not under tension, a second shearing action occurring at the upper gate will occur at a different time, thereby reducing the force requirements. Means are provided to maintain the two gates in alignment while they are in the open condition.

DESCRIPTION OF THE PREFERRED EMBODIMENT

Figure 1:
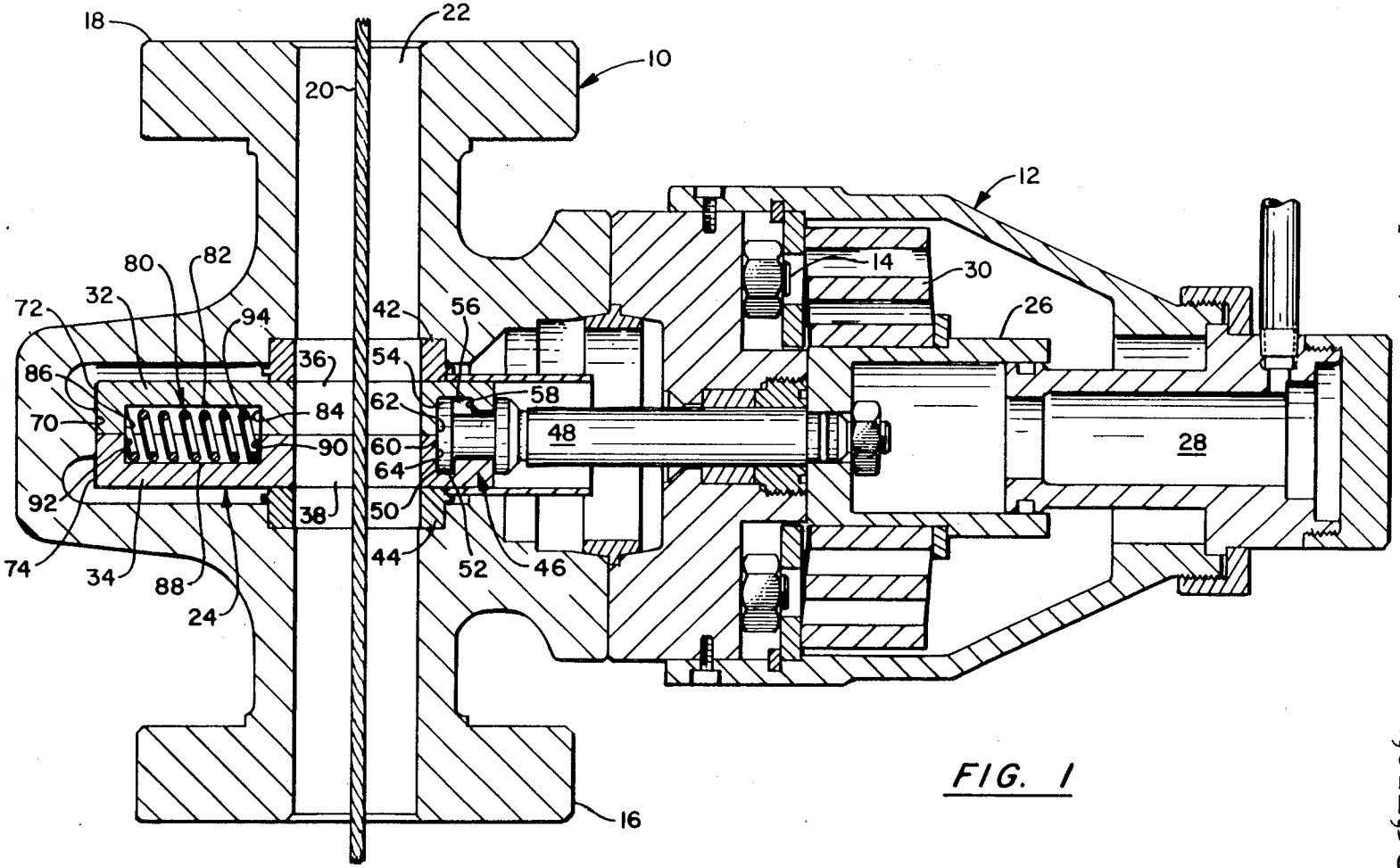
FIG. 1 is a sectional side elevation of the valve in the open position.

Valve body 10 has an actuator 12 attached thereto by means of bolts 14. The valve body included flanges 16 and 18 by which it may be attached to a wellhead either as part of the workover tree or as part of the running apparatus during workover. An elongate suspension member such as a wire line 20 is illustrated passing through the bore of the valve as would be the condition during some workover or testing operations. This wire line would normally be under tension although it occasionally may be in a relaxed condition.

The valve body 10 has an elongate vertical flow passage 22 passing therethrough which is conventionally circular in cross section. A gate assembly 24 is slidably mounted in the valve body for horizontal movement between an open position illustrated in FIG. 1 and a closed position. This gate assembly has a flow port therethrough which is in alignment with the flow passage through the valve body.

The actuator 12 which is connected to the gate assembly, includes a piston 26 which may be actuated by pressure in chamber 28 to move the valve to the open position. A spring 30, operates to close the valve when pressure in chamber 28 is released. The gate assembly 24 comprises an upper gate 32 and a lower gate 34. Each of these gates has a flow port, 36 and 38 respectively, with these ports being alignable with the vertical flow passage 22 of the valve body. The valve body includes an upper valve seat 42 adjacent the upper gate 32 and the lower valve seat 44 adjacent the lower gate 34. The upper valve seat 42 is adapted to seal against the upper surface of gate 32 when the gate is moved to the right to the closed and sealing position. The total clearance between the stack of gates 32 and 34 inside the space between valve seats 42 and 44 should not exceed 250 microns (0.01") so that appropriate shearing action may be obtained as described later on.

Connection means 46 connects the actuator 12 with the gate assembly 24. This connection means includes a lost action connection between the actuator rod 48 and the upper gate 32. The actuator rod 48 has a lower projection 50 which fits within a mating groove 52 of the lower gate 34. Horizontal movement of the actuator stem 48 thereby results in immediate movement of the lower gate 34.

The actuator stem also has an upwardly extending projection 54 which fits within groove 56 of the upper gate 32. This upper groove is of an increased horizontal dimension so that the actuator stem moves a slight distance before the projection 54 abuts against surface 58 of the upper gate 32. Accordingly, gate 32 does not immediately start to travel when actuator stem 48 is moved.

The actuator stem 48 has an abutting surface 60 which abuts against an outwardly facing surface 62 of the upper gate 32 and an outwardly facing surface 64 of the lower gate 34. The valve body 10 has an inwardly facing abutment surface 70 arranged to abut against an outwardly facing surface 72 on the upper gate and an outwardly facing abutting surface 74 on the lower gate. It can be seen that with both the upper and lower gate compressed between the abutment surface 60 of the actuator and the abutment surface 70 of the valve body, alignment of ports 36 and 38 may be maintained.

Also illustrated in FIG. 1 is an alternate alignment means 80 including a recess 82 in the upper gate with the recess having oppositely facing surfaces 84 and 86. The lower gate 34 has a recess 88 having oppositely facing surfaces 90 and 92. A coiled spring 94 is located within both recesses operating against the opposing surfaces to urge the gates into alignment at all times. Either of the alignment means may be used alone or in combination.

Figure 2:
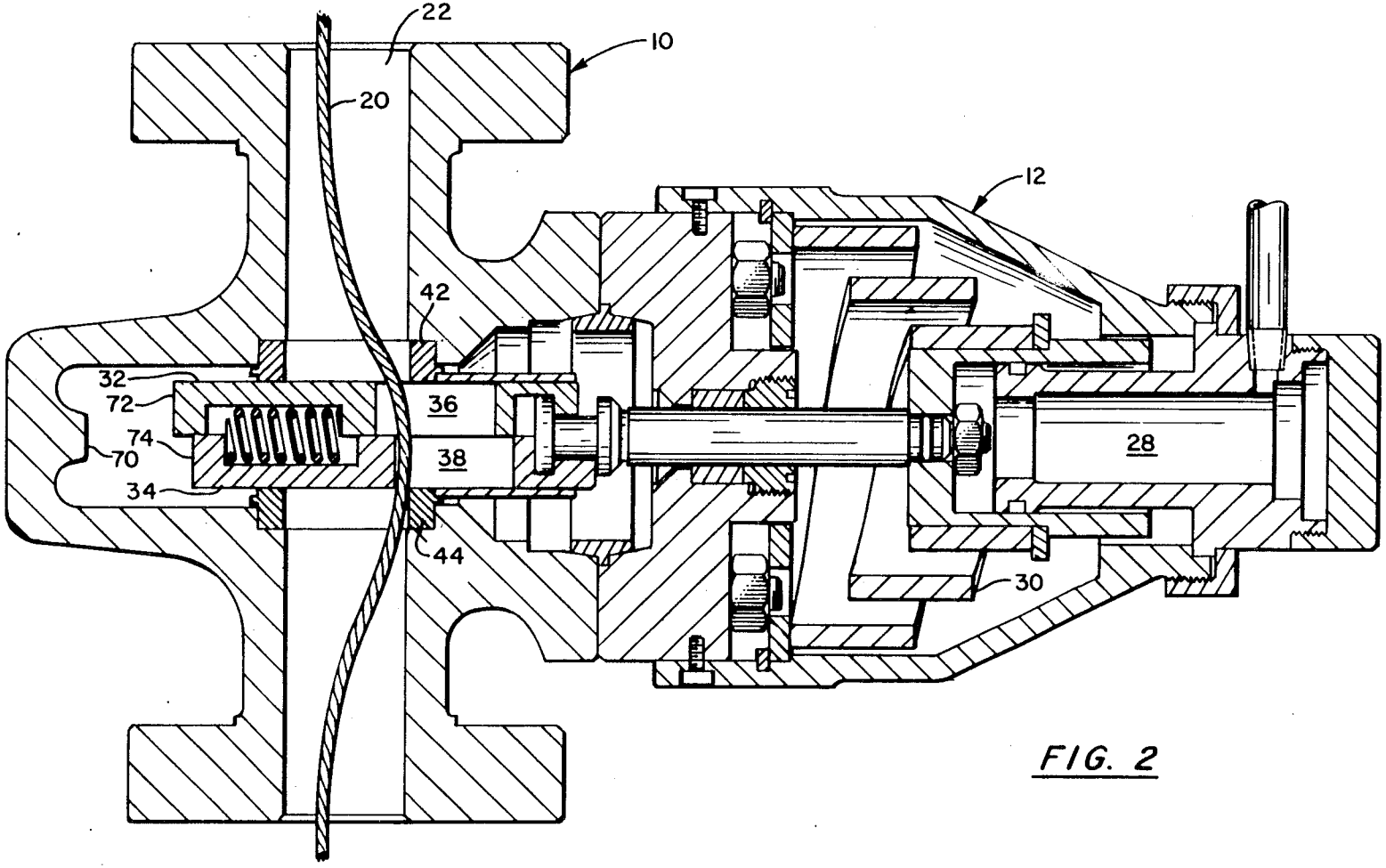
FIG. 2 is a sectional side elevation of the valve in a partially closed condition about to shear a wire line cable passing therethrough.

Should an emergency situation exist, it would comprise a high pressure below the valve. Closing of the valve is initiated by relieving pressure in chamber 28 so that the spring 30 moves the actuator stem 48 to the right. The lower gate 34 is immediately moved to the right with upper gate 32 lagging behind. This produces the situation illustrated in FIG. 2 when the valve is partially closed. It can be seen at this point that the lower gate 34 is about to shear cable 20 against valve seat 44. The upper gate 32 has not yet reached valve seat 42 at this time. If the cable 20 is under tension, it will spring loose from the valve after being sheared by gate 34. Accordingly, gate 32 will not be required to shear the cable thereby avoiding any possibility of damage to seat 42. It is gate 32 which is required for the pressure seal when the well is closed in.

While it is rare, there are times that the wire line 20 is not under tension. In such a situation a first shear will occur by gate 34 with a second shear by the gate 32. This results in shearing at different times rather than in a simultaneous shear thereby reducing the force requirements some 25 to 37%. The sheared portion of cable 20 will be retained in the ports temporarily and dropped out when the valve is later opened.

In closing the valve, the actuator continues to the full closed position where the slabs of the gates close off the vertical flow passage 22 in a conventional manner.

I claim:

1. A gate valve for cutting an elongated suspension member extending therethrough, and closing in a well, comprising:

a valve body having a vertical passage therethrough, and adapted to be mounted on a wellhead;

a gate assembly slidably mounted in said valve body for horizontal movement between an open and closed position;

an actuator connected to said gate assembly for moving said gate assembly to and from said open and closed positions;

connection means connecting said actuator and said gate assembly;

said gate assembly comprising an upper gate and a parallel lower gate;

each of said gates having a flow port therethrough alignable with said vertical flow passage in the open position;

said valve body including valve seats adjacent said gate assembly, said valve seats cooperating with said gate assembly to close said vertical flow passage in a closed position, and at least one of said gates cooperating with one of said seats to seal said vertical flow path in the closed position; and said connection means including a lost motion connection to one of said gates whereby on closing of said valve one of said gates moves ahead of the other so that any elongate member passing through said valve is first sheared by only one gate.

2. A gate valve as in claim 1 wherein said lost motion connection provides lost motion for the upper gate whereby on closing of said valve said lower gate moves first.

3. A gate valve as in claim 2 having also:

means for aligning the ports of said upper and lower gates when the valve is in the open position.

4. A gate valve as in claim 3 wherein said means for aligning ports comprises:

an abutment surface on said upper gate on the same side of the gate as said actuator;

an abutment surface on said lower gate on the same side of the gate as said actuator;

an abutment surface on said upper gate on the opposite side from said actuator;

an abutment surface on said lower gate on the opposite side from said actuator;

an abutment surface on said valve body adapted to abut the surfaces of said upper and lower gates on the side of said actuator;

said connection means having an abutment surface adapted to abut the abutment surface of said upper and lower gates on the side of said actuator, whereby said connection means forces both gates into alignment between the abutment surfaces on each side of the gates so that the flow passages through the upper and lower gates are maintained in alignment.

5. A gate valve as in claim 3:

said upper gate having a recess including oppositely horizontally facing surfaces on the lower side thereof;

said lower gate having a recess including oppositely horizontally facing surfaces on the upper surface thereof;

the oppositely facing surfaces of said upper gate and the opositely facing surfaces of said lower gate being in alignment when the flow openings through said upper and lower gate are in alignment;

compressible resilient means located in said recesses operating against the oppositely facing surfaces of both said upper and lower gate, whereby said resilient means always urges the upper and lower gates into alignment.

6. A gate valve as in claim 2:

the total thickness of said first and second gates being less than the total dimension between the valve seats adjacent the gate assembly by a dimension not exceeding 250 microns.

* * * * *